United States Patent [19]

Hart

[11] 4,120,774

[45] Oct. 17, 1978

[54] REDUCTION OF ELECTRODE OVERVOLTAGE

[75] Inventor: Thomas Gordon Hart, Royal Oak, Mich.

[73] Assignee: Energy Development Associates, Madison Heights, Mich.

[21] Appl. No.: 761,722

[22] Filed: Jan. 24, 1977

[51] Int. Cl.[2] ..... C25B 11/12; C25D 17/10

[52] U.S. Cl. ..... 204/294; 423/445; 423/461

[58] Field of Search ..... 423/445, 461; 204/294

[56] References Cited

U.S. PATENT DOCUMENTS

| | | | |
|---|---|---|---|
| 1,780,154 | 11/1930 | Gardner | 423/461 |
| 3,389,073 | 6/1968 | Vaught et al. | 204/294 |
| 3,475,244 | 10/1969 | Sanders | 423/448 X |

*Primary Examiner*—F.C. Edmundson

*Attorney, Agent, or Firm*—Ostrolenk, Faber, Gerb & Soffen

[57] ABSTRACT

The chlorine overvoltage of carbon and graphite electrodes is considerably and permanently decreased by treatment of the electrodes with nitric acid. The treatment also causes an apparently permanent decrease in the amount of oxygen produced at the electrode coincident with the chlorine generation.

9 Claims, No Drawings

REDUCTION OF ELECTRODE OVERVOLTAGE

BACKGROUND OF THE INVENTION

In any electrochemical reaction, the driving force, i.e., the voltage, is greater than the theoretically necessary voltage and the additional amount of voltage required is known as the overvoltage. Many methods have been used in the past to reduce overvoltage including the use of depolarizers and various structural devices. The problem, however, is complicated because there is an overvoltage associated with each of the gases liberated during the electrochemical reaction.

There are numerous electrochemical processes in which the electrolyte contains halogen ion, particularly chlorine ions, and in which chlorine is generated during the reaction so that there is a chlorine overvoltage associated with the electrochemical cell.

The use of carbon electrodes, i.e., electrodes manufactured of carbon, graphite, activated graphite, and the like, is desirable because of a combination of their relatively low cost and availability. Unfortunately, such carbon electrodes have a significant chlorine overvoltage.

It is accordingly the object of this invention to provide a means for considerably and permanently decreasing the oxidation and reduction chlorine overvoltages of such carbon electrodes. This and other objects of the invention will become apparent to those skilled in the art from the following detailed description.

SUMMARY OF THE INVENTION

This invention relates to a method of decreasing the oxidation and reduction chlorine overvoltages of carbon electrodes by treatment with nitric acid, and to the electrodes thus produced.

DETAILED DESCRIPTION OF THE INVENTION

It has been discovered that the performance of carbon electrodes, i.e., electrodes manufactured from carbon, graphite, activated graphite and the like, can be considerably improved by contact with nitric acid for an effective overvoltage reducing length of time. For example, use of an electrode treated by this method permanently diminished the chlorine overvoltage by at last a factor of 2 in a 25% aqueous zinc chloride solution having a pH of 1.0 and at a current density of 30 mA/cm$^2$. Similar results were obtained in 5% hydrochloric acid at a current density of 300 mA/cm.

In both the zinc chloride and hydrochloric acid situations, there has also been observed an apparently permanent decrease in the amount of oxygen produced at the electrode coincident with the chlorine generation as a result of the nitric acid treatment. Such lower oxygen production at the chlorine electrode is another important advantage of the instant nitric acid treatment since it leads to longer electrode life, higher current efficiency, lower electrolyte contamination and the dimunition of foreign gas problems.

Any carbon electrode can be treated by the instant process so long as it has sufficient internal integrity to withstand prolonged contact with nitric acid. The most important factor in obtaining the reduction in the chlorine overvoltage is time. For example, dilute nitric acid can be used rather than concentrated acid but a much longer contact time will be necessary. Similarly, cold acid rather than hot acid can be used but this also requires a considerable increase in the amount of contact time. Therefore, in order to reduce the duration of the contact time, it is preferred to use hot concentrated nitric acid. Most preferably, boiling (about 120° C.) acid is employed. When nitric acid of any concentration is allowed to boil without recapture of the off-gases, the acid concentration attains a constant value of about 70% and the resulting acid is concentionally known as "B-constant acid." It is preferred to use such boiling B constant nitric acid.

When using boiling B-constant nitric acid, the contact time can vary from about 10 to 1,200 hours, perferably about 80 to 800 hours, and most preferably about 400 to 700 hours. Contact for less than about 10 hours has only a minimal effect on the performance improvement. The improvement achieved after the 1,200 hour point has been reached is small and usually not justified from an economic or convenience point of view.

The occasional application of a partial vacuum above the acid to remove gas trapped in the pores of the material being treated can be helpful depending on the type of carbon electrode being treated. Similarly, renewal of the acid one or more times during the course of the treatment can be helpful depending on the porosity level of the carbon electrode. After the acid treatment is complete, all traces of the acid should be removed by washing, for example, copious hot water washing, and the electrode dried, for example, by baking in air at about 400° C. for 4 hours.

The reason for the improvements achieved with the instant improvement in chlorine overvoltage is not understood but appears to be unique to nitric acid. When hydrochloric acid, sulfuric acid, and hydrofluoric acid have been substituted for the nitric acid, no significant reduction in the chlorine overvoltage has been observed.

In the following table, the overpotentials in millivolts determined for six Airco-Speer 37G porous graphite chlorine electrodes which have been subjected to contact with boiling acid for an extended period of time are set forth. Additionally, results obtained with the same graphite electrode which had previously been used in the electrochemical reaction but had not been acid treated are set forth. The table reports the anodic results for both a 25 weight percent solution of zinc chloride in water at 30° C. and a 20 weight percent solution of hydrochloric acid in water at 30° C. The cathodic overpotentials are similar to the anodic overpotentials.

| | Anodic Overpotential in mV | | | | | | |
|---|---|---|---|---|---|---|---|
| | 100 hours boiling 67% $HNO_3$ | 400 hours boiling 67% $HNO_3$ | 700 hours boiling 67% $HNO_3$ | Untreated | 200 hours boiling 30% $H_2SO_4$ | 200 hours boiling 22% HCl | 200 hours boiling 40% HF |
| 10mA/cm$^2$ | | | | | | | |
| ZnCl | 49 | 34 | 15 | 77 | 69 | 73 | 74 |
| HCl | 27 | 18 | 9 | 33 | 35 | 37 | 37 |

-continued

| | Anodic Overpotential in mV | | | | | | |
|---|---|---|---|---|---|---|---|
| | 100 hours boiling 67% $HNO_3$ | 400 hours boiling 67% $HNO_3$ | 700 hours boiling 67% $HNO_3$ | Untreated | 200 hours boiling 30% $H_2SO_4$ | 200 hours boiling 22% HCl | 200 hours boiling 40% HF |
| 100 mA/cm$^2$ | | | | | | | |
| ZnCl | 191 | 137 | 125 | 257 | 234 | 240 | 223 |
| HCl | 139 | 83 | 62 | 179 | 197 | 183 | 182 |
| 200 mA/cm$^2$ | | | | | | | |
| ZnCl | 253 | 182 | 173 | 283 | 298 | 279 | 302 |
| HCl | 202 | 130 | 98 | 220 | 207 | 231 | 203 |

Some correlation has been found between adsorptive activity properties and nitric treatment. For example, apparent electrical capacities of up to 500 farads per cm$^2$ have been measured on nitric treated carbon compared to about 10 farads on untreated. Electrical capacity is generally taken as proportional to true surface area and therefore to adsorptive activity. Hence the "adsorptive capacity" or, in other words, the "adsorptive activity" of carbon is likely increased by the nitric treatment, much as overvoltage is decreased.

Various changes and modifications can be made in the process and products of this invention without departing from the spirt and scope thereof. The various embodiments of the invention set forth herein were for the purpose of further illustrating the invention but were not intended to limit it.

I claim:

1. A method of decreasing the halogen overvoltage of a carbon electrode which comprises contacting said electrode with nitric acid for an effective overvoltage reducing length of time of about 10–1200 hours.

2. The method of claim 1 wherein said nitric acid is concentrated nitric acid.

3. The method of claim 2 wherein said concentrated acid is hot concentrated acid.

4. The method of claim 3 wherein said acid is boiling B-constant nitric acid.

5. The method of claim 4 wherein said time is about 80 to 800 hours.

6. The method of claim 5 wherein said time is about 400 to 700 hours.

7. A carbon substrate exhibiting a decreased oxidation and reduction halogen overvoltage produced by the process of claim 1.

8. A carbon substrate exhibiting a decreased oxidation and reduction halogen overvoltage produced by the process of claim 3.

9. A carbon substrate exhibiting a decreased oxidation and reduction halogen overvoltage produced by the process of claim 6.

* * * * *